United States Patent [19]

Dozier

[11] Patent Number: 4,480,151

[45] Date of Patent: Oct. 30, 1984

[54] TEMPERATURE STABLE HERMETICALLY SEALED TERMINAL

[76] Inventor: Hilliard Dozier, c/o U.S. Terminals, Inc., 7502 Camargo Rd., Cincinnati, Ohio 45243

[21] Appl. No.: 399,308

[22] Filed: Jul. 19, 1982

[51] Int. Cl.[3] ..... H01R 9/16; H01B 17/26

[52] U.S. Cl. ..... 174/153 R; 339/126 R; 339/192 RL; 339/218 M

[58] Field of Search ..... 174/142, 152 R, 152 GM, 174/153 R; 339/126 R, 126 RS, 192 RL, 214 R, 218 R, 218 M

[56] References Cited

U.S. PATENT DOCUMENTS

| | | | |
|---|---|---|---|
| 1,526,023 | 2/1925 | Steinberger | 174/142 X |
| 2,299,750 | 10/1942 | Hull et al. | 174/152 GM |
| 2,513,305 | 7/1950 | Gagnier et al. | 339/126 RS X |
| 2,748,187 | 5/1956 | Conrad | 174/153 R |
| 3,770,878 | 11/1973 | Dozier | 174/153 R |
| 3,775,547 | 11/1973 | Woods | 174/152 R |
| 4,356,469 | 10/1982 | Dozier | 337/401 |

FOREIGN PATENT DOCUMENTS

| | | | |
|---|---|---|---|
| 482963 | 5/1952 | Canada | 174/152 R |

*Primary Examiner*—Laramie E. Askin
*Attorney, Agent, or Firm*—Frost & Jacobs

[57] ABSTRACT

A hermetically sealed terminal having improved leakage resistance, the terminal comprising a support member having a base with at least one annular opening therein and a pair of concentric sleeves associated with the opening and projecting outwardly from one side of the base, with an elongated terminal pin extending centrally through the sleeves, the terminal pin being secured to the support member by a molded dielectric sealing member bonded to the terminal pin and to the opposite surfaces of the base, integral portions of the sealing member filling the innermost sleeve and the annular space between the two sleeves and being bonded to the inner and outer surfaces of the sleeves to effectively increase the area of interface between the sealing member and the support member so as to inhibit the formation of leakage paths from one side of the terminal to the other due to thermal expansion and contraction of the parts. The invention also contemplates the provision of an improved terminal pin construction to inhibit the formation of leakage paths between the terminal pin and the sealing member, the terminal pin having knurled portions extending outwardly beyond the opposite ends of the sleeve which effectively prevents transmission of torque forces between the outer ends of the pins and the central portion thereof lying between the knurls.

6 Claims, 6 Drawing Figures

TEMPERATURE STABLE HERMETICALLY SEALED TERMINAL

This invention relates to hermetically sealed terminals, and more particularly to terminals of the type wherein one or more conductor pins project through and are secured to a supporting body by means of a seal which electrically insulates the conductor pins from the supporting body and at the same time hermetically seals the pins against the exchange of atmosphere between one side of the terminal body and the other.

BACKGROUND OF THE INVENTION

The present invention is directed to an improvement in the type of hermetically sealed electrical terminal taught in U.S. Pat. No. 3,770,878, issued Nov. 6, 1973 and entitled "Hermetically Sealed Electrical Terminal". In accordance with this patent, one or more highly conductive conductor pins formed from materials, such as copper and copper alloys, are electrically insulated from a supporting member, such as a ferrous metal shell, by means of a molded dielectric sealing member which coacts with the conductor pins and the supporting member to provide a hermetically sealed terminal. Such terminals are widely used in refrigeration headers wherein an electrical connection is made with components mounted within a sealed receptacle or chamber containing fluid, either liquid or gaseous, which is under pressure. An essential prerequisite of such terminals is the provision of a seal which is capable of maintaining a tight bond with both the conductor pins and the supporting body irrespective of environmental conditions, such as elevated temperatures or testing procedures which may act to interfere with the effectiveness of the seal by providing leakage paths which will permit fluid to escape through the header.

While electrical terminals of the type taught in the aforementioned patent have proven to be highly successful in applications wherein temperatures of up to 400° F. are encountered, it has been found that leakage can occur where temperatures in excess of 400° F. are encountered, and it has been a desire in the industry to provide terminals which remain reliably sealed to temperatures up to 500° F.

Another source of potential leakage results from testing procedures utilized to test the integrity of conductor tabs which may be welded to either or both ends of the conductor pins to facilitate the attachment of conductive wiring to the pins. A conventional test is to apply a twisting or torque force to the tabs to be certain they are tightly bonded to the pins. Such forces are transmitted to the pins and even a very slight movement of the pins relative to the sealing material will result in the formation of a leakage path along the interface of the pin with the seal. While terminal pins have heretofore been provided with a centrally disposed knurl to inhibit rotation of the pins, such arrangement will not ensure against leakage along the pin if both ends of the pin are provided with conductor tabs and subjected to torque forces.

The present invention provides an improved terminal construction which effectively prevents the formation of leakage paths between the sealing member and the supporting body and also between the sealing member and the terminal pins. This new construction is temperature stable and provides reliability under higher temperatures than terminals currently in use.

FIG. 1 illustrates a prior art hermetically sealed terminal of the type disclosed in U.S. Pat. No. 3,770,878. As seen therein, the terminal comprises a supporting member or body 1 which is the type used in compressors for refrigeration equipment, the body being of cup-shaped configuration and having an annular body wall 2 terminating at one end in an outturned mounting flange 3 and at its opposite end in a base 4 interrupted by spaced apart sleeves or sockets 5 lying within the confines of the annular body wall 2. The supporting member 1 mounts conductor pins 6 which extend axially through the sleeves 5, the conductor pins being secured in place and hermetically sealed by means of a sealing member 7, which is preferably a unitary member composed of a dielectric material molded in situ to the desired configuration.

In the event excessive temperatures are encountered which cause differential expansion of the parts or creeping of the sealing member relative to the surfaces of the supporting member, leakage paths may develope between the points 8 and 9, such leakage paths being diagrammatically indicated by the dotted line 10. As will be evident, such path is relatively short and basically involves the flow of fluid around the inner and outer surfaces of the sleeve 5.

If the terminal pins 6 are provided with conductor tabs 11, similar leakage paths may be formed between the pins 6 and the sealing member 7 as an incident of testing the integrity of the attachment of the conductor tabs to the pins. When torque forces are applied, the pins will tend to rotate relative to the sealing member and even an extremely small movement may break the bond between the pins and the sealing member. While in the embodiment illustrated, the terminal pin is provided with a knurl 12 located within the confines of the sleeve 5 to prevent rotation of the pin, the position of the knurl is such that it does not effectively prevent the formation of leakage paths 13 and 14. If only the outer ends of the pins are provided with conductor tabs, the leakage path 13 alone is normally insufficient to pose a problem; however, if the inner ends of the terminal pins are also provided with conductor tabs, the presence of both leakage paths 13 and 14 can pose a problem in that the application of torque to both ends of the pins may result in a loss of integrity of the sealing member in the area of the knurl, thereby permitting fluid under pressure to escape.

SUMMARY OF THE INVENTION

In accordance with the present invention, the leakage problem between the supporting member and the sealing member is overcome by providing a pair of concentric sleeves surrounding each of the pins, with the sealing member bonded to the inner and outer surfaces of both sleeves in each pair. With such arrangement, the bonding surface areas are greatly increased, thereby materially lessening the likelihood that a leakage path will develope. In addition to increasing the surface area of the supporting member which is bonded to the sealing member, the concentric sleeves coact to stabilize the sealing member by controlling the contraction of the sealing material as it is molded and cured, the concentric sleeves also acting to control plastic flow and creep of the sealing member after molding.

In practicing the invention, a support body having conventional sleeves may be utilized, the sleeves being adapted to receive tubular inserts provided with shoulders which serve to position the inserts relative to the existing sleeves and additionally provide a medium for welding the inserts in place.

In the event a problem is encountered with leakage between the pins and the portions of the sealing member in contact therewith due to torque forces applied to the pins as an incident of testing conductor tabs affixed to the opposite ends of the pins, an improved terminal pin construction is provided wherein the pins are provided with spaced apart pairs of knurls which effectively serve to prevent rotation of the portions of the pins lying between the knurls, thereby ensuring the maintenance of a tight bond between the sealing member and the pins in the critical area where leakage paths might otherwise be formed.

While the present invention will be described in conjunction with a three pin terminal of the type used in refrigeration headers, it will be understood that the invention may be used with various types of single or multiple pin terminals, as well as in applications where the support for the conductor pins comprises an integral part of a housing or other sealed component to which electrical current is to be supplied.

DESCRIPTION OF THE PREFERRED EMBODIMENT

Figure 1:
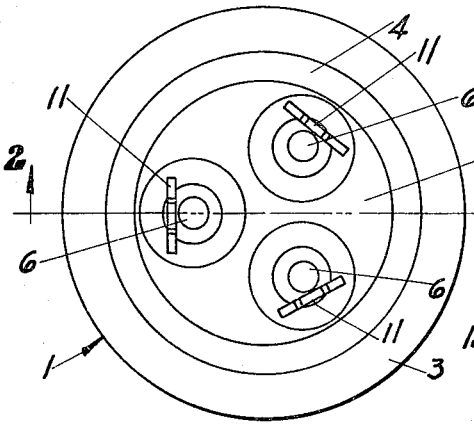
FIG. 1 PRIOR ART
FIG. 1 is a top plan view of a terminal construction in accordance with the prior art.
Figure 2:
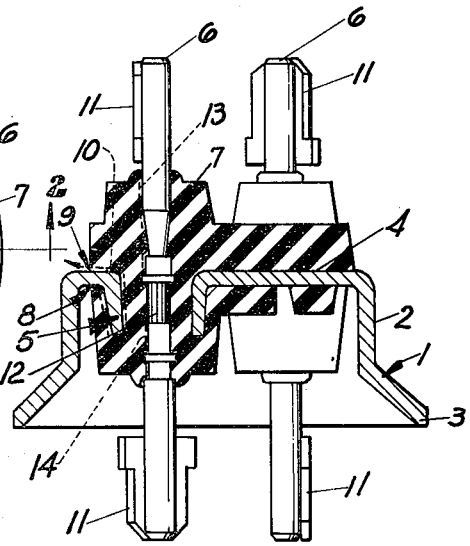
FIG. 2 PRIOR ART
FIG. 2 is a vertical sectional view of the prior art terminal taken along the line 2—2 of FIG. 1.
Figure 3:
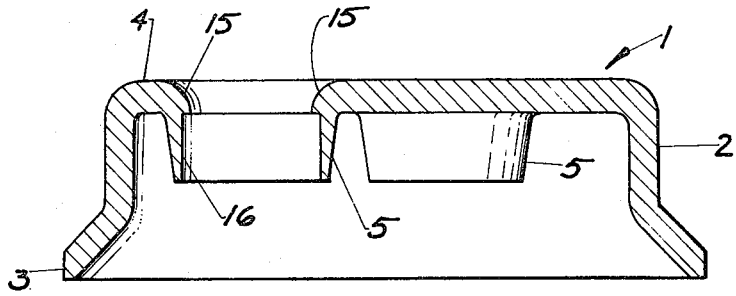
FIG. 3 is an enlarged vertical sectional view in the same plane as FIG. 2 illustrating the modification of the sleeves of the supporting member to accommodate the sleeve insert.

Referring first to FIG. 3 of the drawings, the support member or body 1 is essentially the same as that described in connection with FIGS. 1 and 2, namely, it is of cup-shaped configuration, having an annular body wall 2 terminating at one end in a mounting flange 3 and at its opposite end in a base 4 interrupted by spaced apart sleeves 5, the sleeves having rounded annular shoulders 15 at their juncture with the base 4. In order to accommodate a sleeve insert, the inner surfaces of the sleeves 5 are cut away to provide an annular recess 16 which serves to effectively increase the inside diameter of the sleeves.

Figure 4:
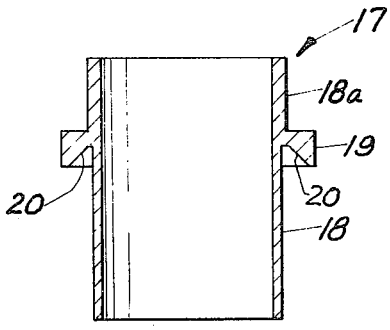
FIG. 4 is an enlarged vertical sectional view of the sleeve insert.

The sleeve insert is indicated at 17 in FIG. 4, the insert comprising a cylindrical body 18 of a size to pass through the annular shoulders 15 of the sleeves 5. The insert has an integral annular flange 19 projecting outwardly therefrom, the flange preferably being undercut in the manner indicated at 20. In the embodiment illustrated, a portion of the cylindrical body, indicated at 18*a*, projects upwardly beyond the annular flange 19, although depending upon the conditions of use, the cylindrical body 18 may terminate at the annular flange 19. As will also be evident from FIG. 4, the wall thickness of the body portion 18*a* may be greater than the wall thickness of the body portion 18.

Figure 5:
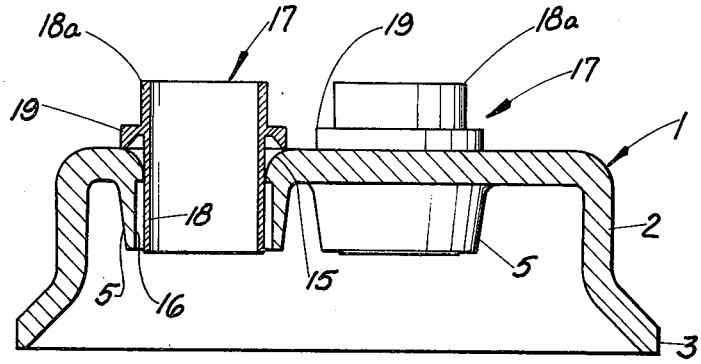
FIG. 5 is a vertical sectional view similar to FIG. 3 showing the sleeve inserts as initially seated in the sleeves of the supporting member prior to welding.

The sleeve inserts 17 are initially seated on the supporting members 1 in the manner illustrated in FIG. 5, with their annular flanges 19 overlying the rounded annular shoulders 15 of the sleeves 5. Upon being seated, the annular flanges 19 are welded to the supporting member in the areas of the shoulders 15, as by a resistance welding operation, and as an incident of such operation the sleeve inserts will be displaced downwardly as the flanges are fused into the shoulders 15, the parts thus assuming the position illustrated in FIG. 6 wherein it will be seen that the flanges have fused into the shoulders of the sleeves. This fusing action is facilitated by the undercutting of the annular flanges 19.

Figure 6:
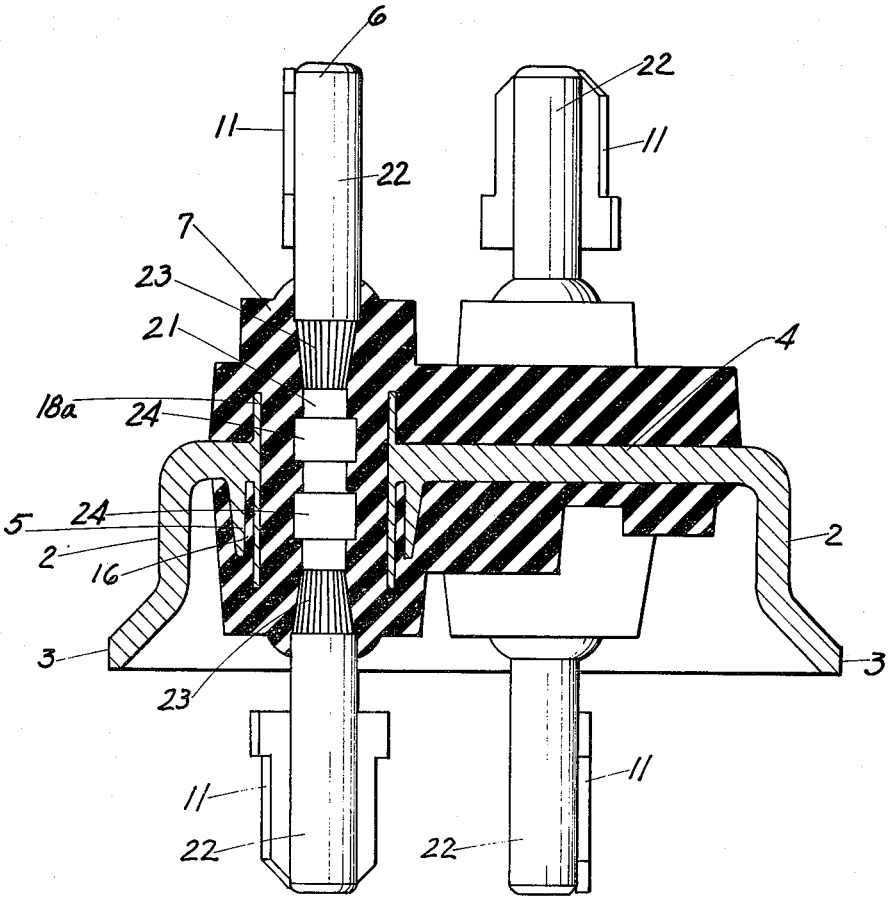
FIG. 6 is a vertical sectional view of the fully assembled terminal, including the conductor pins and sealing member.

As will be evident from FIG. 6, the cylindrical body 18 of the sleeve insert lies in spaced relation to the sleeve 5, the sleeves being separated by a distance defined by the cut-away inner surface 16 of the sleeve 5. It will be understood that the supporting member 1 and the sleeve insert 17 may be formed from any compatible material suitable for the purpose, although for most installations the parts preferably will be formed from steel which is relatively inexpensive and readily lends itself to being welded.

Following the assembly of the supporting member and the sleeve inserts, the sealing member 7 is applied, the sealing member being formed from a dielectric material capable of being molded in situ to the supporting body and conductor pins. Various molding compounds may be employed, the principal considerations being the provision of a material having sufficiently low resistance to flow so that its direction and extent of flow may be controlled during molding, the material having a coefficient of linear expansion which is compatible with the coefficients of expansion of the parts, including the conductor pins. The molding material may be essentially rigid when cured, such as an epoxy molding compound, or it may comprise a material which is relatively soft and capable of being flexed. Synthetic elastomers, such as chlorosulfate polyethylene, may be used.

As will be apparent from FIG. 6, the sealing material flows into the annular space 16 between the sleeve 5 and the cylindrical body 18 of the insert. The sealing material also surrounds and bonds to the outwardly projecting cylindrical portion 18*a* of the sleeve insert, if such is used. In net effect, the sleeve insert greatly increases the areas of the sealing member which are bonded to the supporting member, and it will be evident that for leakage to occur, the fluid must flow not only around the sleeves 5 but also around the sleeve inserts 17. The length of such paths of travel, coupled with the tendency of the sealing material to shrink inwardly, ensures that substantial contacting areas of the sealing member will remain tightly bonded to the sleeves and hence prevent the formation of leakage paths.

In instances where both ends of the terminal pins 6 are provided with conductor tabs 11, it is preferred to utilize the pin configuration shown in FIG. 6 wherein the central portion 21 of each pin is connected to the outer portions 22 by means of tapered knurls 23, the dimensioning of the parts being such that the central portion 21 of each pin lies within the confines of the corresponding sleeve insert, with the knurls 23 extending outwardly beyond the opposite ends of the sleeve insert. With this arrangement, the knurls effectively prevent rotation of the central portion of the pin, and a relatively large surface area is provided which remains tightly bonded to the sealing member irrespective of twisting movement of the outer portions of the pins due to the testing of the bond between the conductor tabs 11 and the pin. In this connection, the enlarged shoulders 24 on the central portion of the pin further enhance the surface area of the bond and additionally serve to resist contraction of the sealing material during curing in directions which would tend to elongate and hence contract the sealing member in the area lying within the confines of the sleeve insert.

As should now be evident, the present invention, due to the presence of the sleeve inserts, provides enhanced thermal stability for the terminal and provides materially enhanced resistance to the formation of leakage paths from one side of the terminal to the other. In addition, in situations where the bond between the sealing member and the pins is jeopardized by testing procedures relating to the conductor tabs, an improved pin configuration is provided which effectively isolates the central area of the pin from movement, again ensuring the integrity of the bond between the parts.

What is claimed:

1. A hermetically sealed terminal construction comprising a support member having a base with at least one annular opening therein and a rounded annular shoulder at said opening, a first cylindrical sleeve in the form of an insert having a cylindrical body and an outwardly projecting annular flange surrounding said cylindrical body fitted in said opening and projecting outwardly from at least one side of said base with said annular flange seated against and welded to said base in the area of said annular shoulder, a second cylindrical sleeve surrounding said first sleeve in spaced relation thereto, said second cylindrical sleeve being integrally formed with said base and affixed at one end to said base in the area surrounding said opening, said sleeves defining an annular recess therebetween, an elongated terminal pin extending centrally through said sleeves, and a molded dielectric sealing member securing said terminal pin to said support member, said sealing member being bonded to said terminal pin and to the opposite surfaces of said base with integral portions thereof filling said first sleeve and said annular recess and bonded to the inner and outer surfaces of said sleeves, whereby to effectively increase the area of interface between said sealing member and said support member to thereby inhibit the formation of leakage paths from one side of the support member to the other due to thermal expansion and contraction of the parts.

2. The terminal construction claimed in claim 1 wherein said annular shoulder lies intermediate the opposite ends of the cylindrical body of said first sleeve.

3. The terminal construction claimed in claim 2 wherein said first sleeve projects outwardly from both sides of said base.

4. The terminal construction claimed in claim 3 wherein said terminal pin has a central portion lying within the confines of said first sleeve, said central portion having at least one enlarged shoulder thereon.

5. The terminal construction claimed in claim 4 wherein said terminal pin has a knurled portion at each end of said central portion, said knurled portions extending outwardly beyond the ends of said first sleeve, said knurled portions lying within the confines of said sealing member.

6. The terminal construction claimed in claim 5 wherein said knurled portions are of tapered configuration.

* * * * *